US009293067B1

(12) United States Patent
Johns

(10) Patent No.: US 9,293,067 B1
(45) Date of Patent: Mar. 22, 2016

(54) DEVICE FOR MARKING A WIRE

(71) Applicant: Extundo Incorporated, Louisville, KY (US)

(72) Inventor: Clifford L. Johns, Louisville, KY (US)

(73) Assignee: Extundo Incorporated, Louisville, KY (US)

( * ) Notice: Subject to any disclaimer, the term of this patent is extended or adjusted under 35 U.S.C. 154(b) by 301 days.

(21) Appl. No.: 13/790,130

(22) Filed: Mar. 8, 2013

Related U.S. Application Data

(60) Provisional application No. 61/616,178, filed on Mar. 27, 2012.

(51) Int. Cl.
*G09F 3/00* (2006.01)
*G09F 3/02* (2006.01)

(52) U.S. Cl.
CPC ..... *G09F 3/02* (2013.01)

(58) Field of Classification Search
CPC ..... H01B 7/368; G09F 3/205; G09F 3/06; G09F 3/0295
USPC ..... 40/316; 116/201, 321
See application file for complete search history.

(56) References Cited

U.S. PATENT DOCUMENTS

| | | | | |
|---|---|---|---|---|
| 4,114,654 | A | 9/1978 | Richardson | |
| 4,312,708 | A | 1/1982 | Leslie | |
| 4,493,344 | A | 1/1985 | Mathison et al. | |
| 5,474,268 | A * | 12/1995 | Yu | 248/61 |
| 5,771,835 | A | 6/1998 | Schneider | |
| 6,237,263 | B1 * | 5/2001 | Hagstrom et al. | 40/316 |
| 6,420,657 | B1 * | 7/2002 | Fang et al. | 174/112 |
| D670,598 | S * | 11/2012 | Dunn | D11/184 |
| 2003/0089005 | A1 * | 5/2003 | Caveney | 40/316 |
| 2006/0162724 | A1 | 7/2006 | Scarrott et al. | |
| 2009/0038773 | A1 | 2/2009 | Johns et al. | |
| 2009/0095211 | A1 | 4/2009 | Johns et al. | |
| 2012/0137517 | A1 | 6/2012 | Johns et al. | |
| 2013/0167868 | A1 * | 7/2013 | Brewer | 134/6 |

* cited by examiner

*Primary Examiner* — Joanne Silbermann
(74) *Attorney, Agent, or Firm* — Camoriano and Associates

(57) ABSTRACT

A device for marking a wire projecting from the tube of a shell and tube heat exchanger includes first and second legs which cooperate to form a tubular body with opposed openings for receiving the wire, and a hinge at a first end of the tubular body about which the body flexes to enable insertion of the wire into the openings.

9 Claims, 8 Drawing Sheets

DEVICE FOR MARKING A WIRE

This application claims priority from U.S. Provisional Application Ser. 61/616,178 filed Mar. 27, 2012, which is hereby incorporated herein by reference.

BACKGROUND

The present invention relates to a device for marking and identifying a wire, particularly a thermocouple, in a chemical reactor.

Many chemical reactors are essentially a large shell and tube heat exchanger vessel, with the reaction occurring inside the tubes and a coolant circulating in the vessel outside the tubes. There may be catalyst inside the tubes, which needs to be replaced periodically.

The reactor tubes may be quite long, housed in a structure several stories tall. Some of the reactor tubes may house a thermocouple wire used to sense the temperature in order to monitor the chemical reaction taking place in the reactor vessel. The thermocouple wire may be delicate, fragile, and difficult for catalyst changeover personnel to see inside the reactor vessel. When work is being done inside the reactor vessel, such as in a catalyst changeover, it is desirable to mark the thermocouple wire so it is visible to the personnel. Also, it is desirable to be able to mark the thermocouple wire to identify it before it is removed from the reactor tube so it may be replaced in the correct reactor tube during reloading of the tubes in the reactor vessel.

SUMMARY

The present invention relates to a device and method for marking and identifying a wire used in a shell-and-tube heat exchanger, such as in the tubes of a vertical tube chemical reactor. In one embodiment, the marking device includes a mechanism to provide tamper-proof evidence that it has remained in its original location and has not been removed and installed in some other location.

DESCRIPTION

Figure 1:
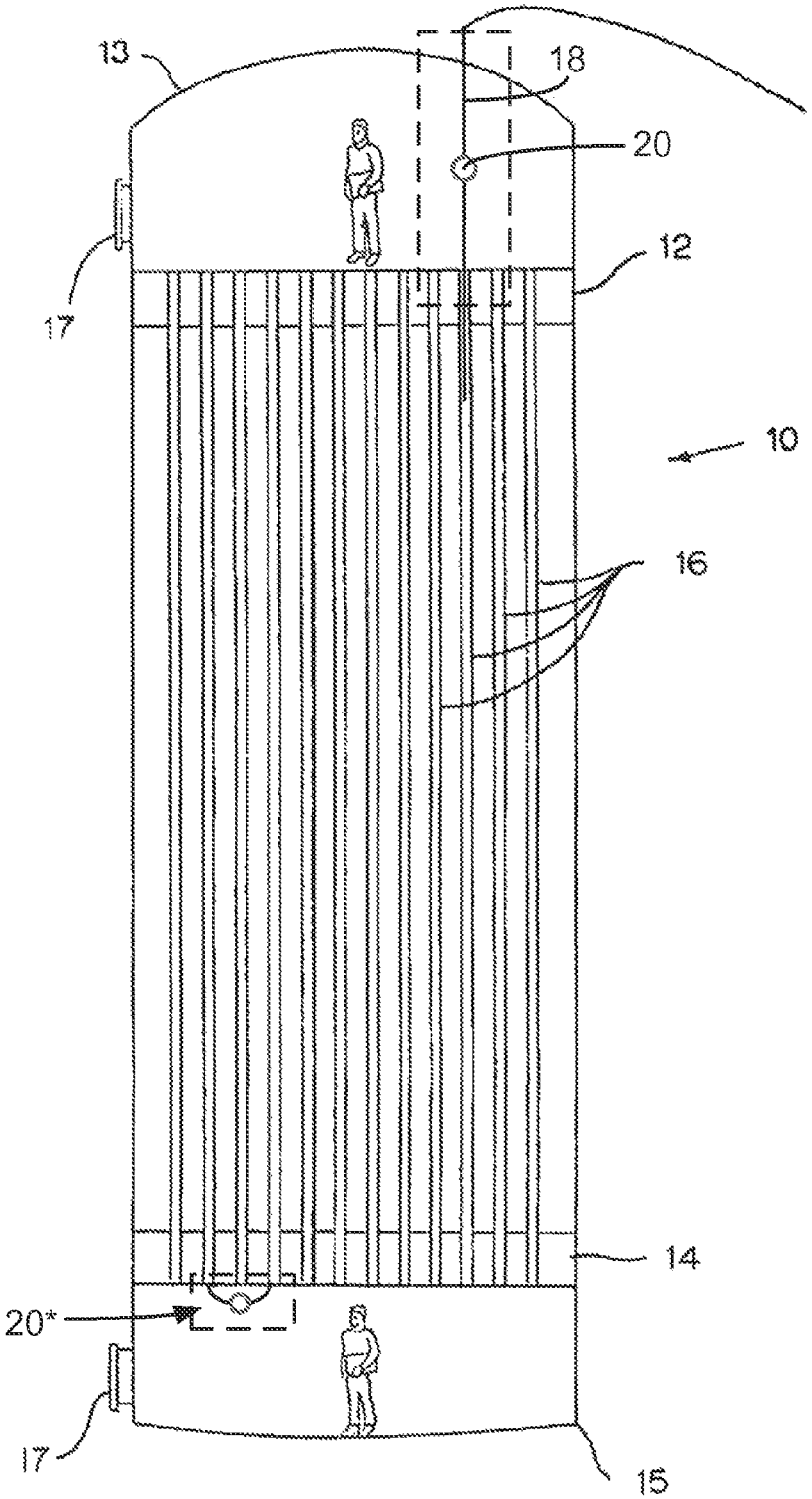
FIG. 1 is a schematic, section view of a shell and tube type of chemical reactor vessel using a marking device in accordance with the present invention.

FIG. 1 depicts a typical shell and tube chemical reactor vessel 10, having an upper tubesheet 12 and a lower tubesheet 14 with a plurality of vertical tubes 16 welded or expanded to the tubesheets 12, 14 to form a tightly packed tube bundle. There may be from one to many hundreds or even thousands of cylindrical tubes 16 extending between the tubesheets 12, 14. Each tube 16 has a top end secured to the upper tubesheet 12 and a bottom end secured to the lower tubesheet 14, and the tubes 16 are open at both ends, except that there may be a spring, clip or grid at the bottom end to retain catalyst pellets inside the tube. The upper and lower tubesheets 12, 14 define a plurality of openings that are the size of the outside diameter of the tubes 16, with each tube 16 being located in respective openings in the upper and lower tubesheets 12, 14.

The vessel 10 includes a top dome (or top head) 13 and a bottom dome (or bottom head) 15, as well as manways 17 for access to the tubesheets 12, 14 inside the vessel 10. The manways 17 are closed during operation of the reactor but are opened for access, such as during catalyst handling. In this instance, the tubes 16 are filled with catalyst particles, which facilitate the chemical reaction. (It may be noted that shell and tube heat exchangers may be used for other purposes, such as for a boiler or other heat exchanger.)

Reactors have either fixed or removable heads. In this embodiment, the heads are fixed, and they include manways 17 at the top and at the bottom.

This particular reactor vessel 10 is fairly typical. Its tubes may range in length from 5 feet to 65 feet, and it is surrounded by a structural steel skid or framework (not shown), which includes stairways or elevators for access to various levels of the reactor vessel 10. On a regular basis, which can be every 2 to 48 months or longer, as the catalyst becomes less efficient, less productive, or "poisoned", it is changed out, with the old catalyst being removed and a new charge of catalyst being installed in the tubes 16 of the reactor vessel 10. Catalyst handling also may have to be done on an emergency basis, on an unplanned or otherwise undesirable schedule.

A catalyst change operation (also referred to as a catalyst changeover) involves a complete shutdown of the reactor, which may result in considerable cost due to lost production. It is desirable to minimize the amount of time required for the catalyst change operation in order to minimize the lost production and accompanying cost caused by the reactor shutdown as well as for other reasons.

Some of the reactor tubes 16 house a thermocouple wire 18. These thermocouple wires 18 are used to monitor the chemical reaction taking place in the reactor vessel 10. FIGS. 2-10 show various embodiments of devices 20 for marking and identifying the wires 18, as described below.

Figure 2:
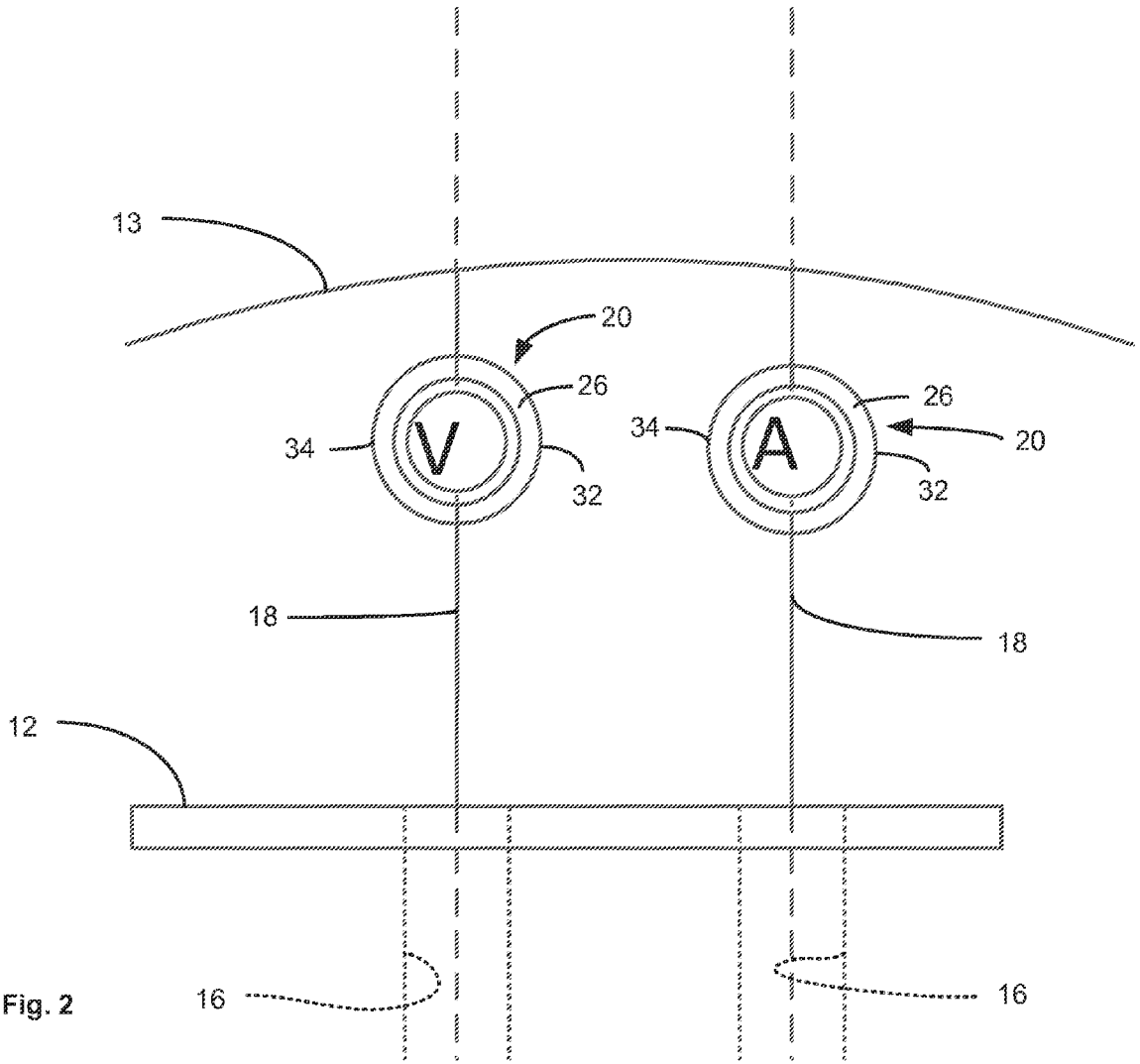
FIG. 2 is a broken away, enlarged view of the upper right portion of the reactor vessel of FIG. 1, including two thermocouple wires, each including a marker.
Figure 3:
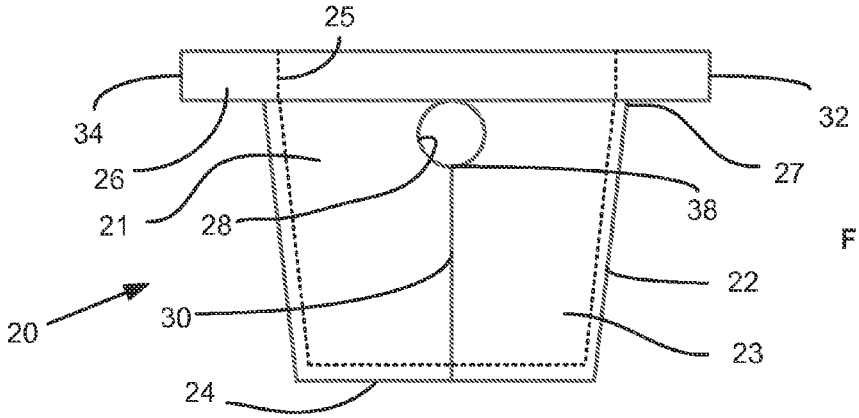
FIG. 3 is a top view of one of the markers of FIG. 2.
Figure 4:
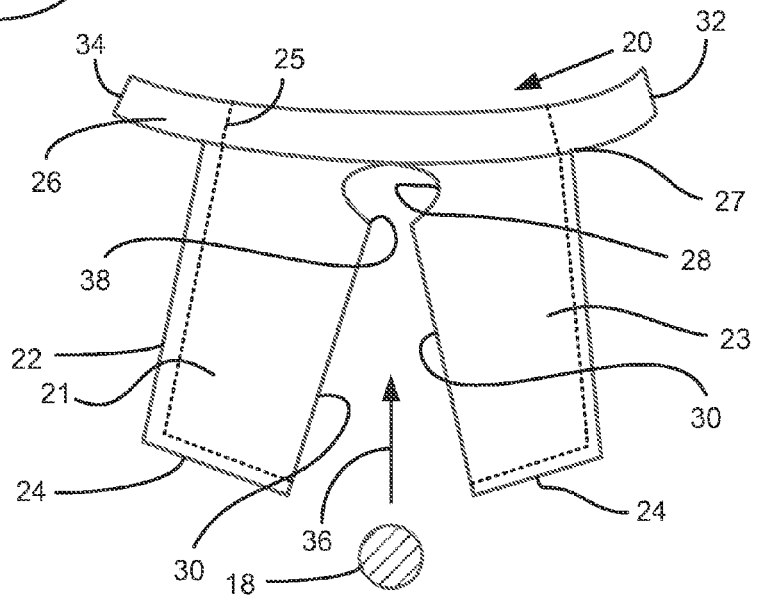
FIG. 4 is a top view of the marker of FIG. 3 in the open position, showing also a section view of the thermocouple wire.

Referring now to FIGS. 2 and 3, the marker 20 has first and second legs 21, 23, each having first and second ends 27, 24 and first and second side edges 30. A flange 26 connects said first ends 27 together. The flange 26 defines a live hinge, which flexes to an open position to allow the second ends 24 of the legs 21, 23 to separate from each other as shown in FIG. 4.

In the hinged closed position, as shown in FIG. 3, the side edges 30 of said first and second legs 21, 23 lie adjacent to each other and cooperate so the legs 21, 23 form a tubular body wall 22. The side edges 30 of the legs 21, 23 define first and second diametrically opposed openings 28 through the body wall 22 adjacent to the first end 27 for receiving a wire 18. The live hinge is biased in the hinged closed position. The side edges 30 abut each other along an imaginary plane.

As shown in FIG. 3, the tubular body wall 22 has an imaginary longitudinal axis that is in the generally vertical direction. The opposed openings 28 in the tubular body wall 22 lie on the first and second ends of an imaginary crosswise line segment that extends crosswise, across the imaginary longitudinal axis. The flange 26 projects radially outwardly from the tubular body at the first ends 27 of the legs 21, 23.

This embodiment of a marker 20 is molded as a flexible plastic member, with the tubular body 22 (See FIG. 3) being closed at one end 24 and with the flange 26 surrounding the opening 25 at the other end. Two diametrically opposed points 32, 34 on the edge of the flange 26 define an imaginary line that is perpendicular to the plane along which the side edges 30 abut each other. As may be appreciated in FIG. 4, pinching the flange 26 at those opposed points 32, 34 causes the portion of the flange 26 adjacent to the side edges 30 to serve as a live hinge (with the pivot point of the live hinge aligned with the side edges 30), allowing the first and second legs 21, 23 to separate from each other at their second ends 24.

This marker 20 is made from a plastic material such as low density polyethylene, which is elastic and wants to return to its relaxed, non-flexed (hinged closed) position (as shown in FIG. 3) when it is released. In other words, the live hinge is biased in the hinged closed position.

Figure 5:
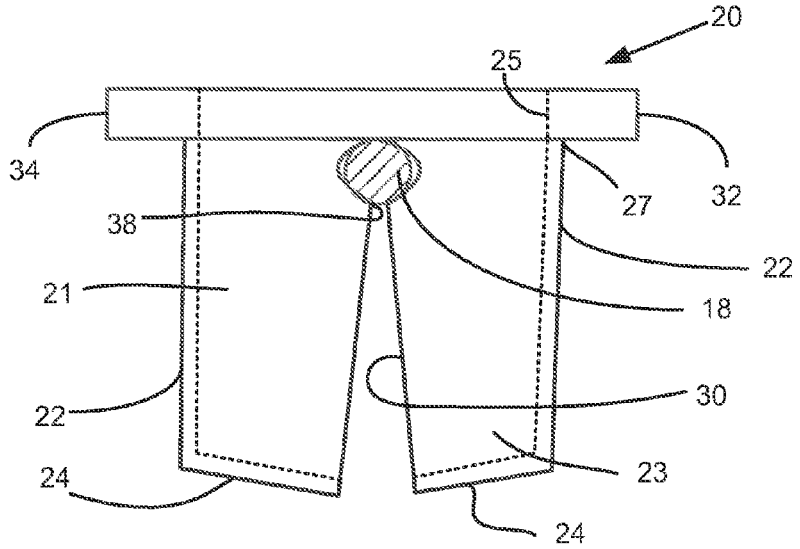
FIG. 5 is a top view of the marker of FIG. 4, with the marker attached to the thermocouple wire.

When the marker 20 is in the hinged closed position of FIG. 3, the openings 28 preferably are slightly smaller in diameter than the diameter of the wire 18 so the biasing of the live hinge presses the edges 30 of the legs 21, 23 against the wire 18 at the openings 28 so the marker 20 will grip the wire 18 (as shown in FIG. 5). The marker 20 preferably is provided in a bright color to make it readily visible to the catalyst changeover personnel inside or near the reactor vessel 10. It should be noted that the outside diameter of the flange 26 is larger than the inside diameter of the reactor tubes 16 (See FIGS. 1 and 2), such that the marker 20 cannot fall into a tube 16 if the marker is dropped inside the reactor vessel 10.

To install the marker 20 onto a wire 18, the user puts his thumb on one of the points 32, 34 and his forefinger on the other of the points 32, 34 and pinches together his thumb and forefinger, which causes the marker 20 to flex along the live hinge formed by the flange 26, separating the second ends 24 of the first and second legs 21, 23, as shown in FIG. 4. He then slides the wire 18 between the first and second legs 21, 23 in the direction of the arrow 36 until the wire 18 reaches the openings 28 (or he slides the marker 20 onto the wire 18). As the wire 18 enters into the openings 28, the user feels a click (or tactile feedback) as the wire 18 goes past the choke points 38 where the distance between the legs 21, 23 abruptly increases at the entrance to the openings 28. Once the user feels the two clicks (one click corresponding to the wire 18 passing the choke point 38 at each opening 28), he knows that the marker 20 is properly mounted onto the wire 18, as shown in FIG. 5, and the user can release the marker 20 which allows the live hinge, which is biased in the hinged closed position, to return to the hinged closed position. As may be appreciated, the edges 30 of the legs 21, 23 at the diametrically opposed openings 28 enclose and grip the wire 18 to hold the marker 20 on the wire 18.

The marker 20 may be repositioned along the length of the wire 18 by slightly under-pinching the flange 26 at points 32, 34 to relax the frictional grip that the marker 20 has on the wire 18, and then sliding the marker 20 along the continuous length of the wire 18. The materials of the marker 20 and the dimensions of the openings 28 are selected so that, when the flange 26 is released, the marker 20 grips the wire 18 with enough frictional force that it remains in position and does not slide down the wire 18. Depending upon the amount of friction between the marker 20 and the wire 18, the user may simply push the marker 20 along the length of the wire 18 to relocate the marker 20. Since the marker 20 is made of a lightweight plastic material and is hollow, it is very lightweight, so it does not require much frictional force to keep it in place.

As shown in FIG. 2, some type of indicia may be placed on the marker 20, such as one or more letters, numbers, patterns, images, or any other indicia to identify the wire onto which the marker 20 is placed. In this embodiment, the indicia are made by writing on the inner surface of the closed end 24 of the marker 20 with a permanent marker. The indicia alternatively may be placed on the outer surface of the closed end 24 or in some other location on the marker 20 that can be seen by the user, or indicia may be placed in more than one location.

Figure 5A:
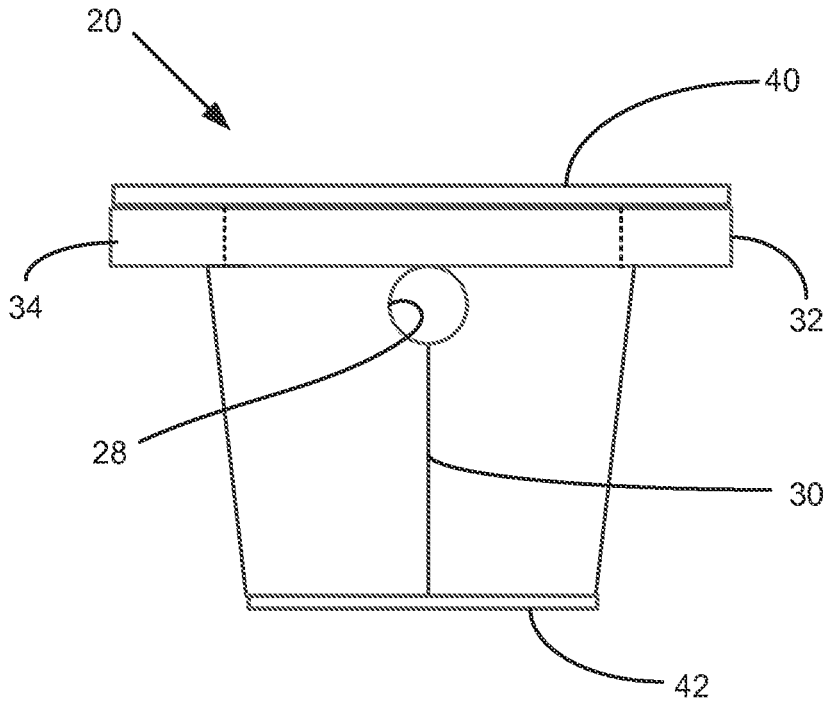
FIG. 5A is a top view of a marker with indicia adhered to the surface of the marker.

FIG. 5A shows an arrangement in which the indicia are applied by adhering one or more stickers or decals or plates 40, 42 onto the marker 20. The decals or plates 40, 42 may include patterns or images, such as those shown in FIG. 2, used to identify the wire being marked by the marker 20.

If the identifying sticker 42 (or plate) is secured to the closed end 24 of the marker 20 after the marker 20 is secured to the wire 18, with the sticker 42 spanning across both legs 21, 23 and holding the two legs 21, 23 of the marker 20 together, then the identifying sticker or plate 42 can function as a tamper evident marker. If the identifying sticker or plate 42 is made using a strong material, such as an aluminum plate, and if it is secured using a VHB (Very High Bond) tape or some other permanent securement, the identifying sticker or plate 42 not only becomes a tamper evident marker, it is also would require the destruction of the marker 20 in order to remove the marker 20 from the wire 18. The identifying stickers or plates 40, 42 may be used with any of the markers described herein.

Figure 6:
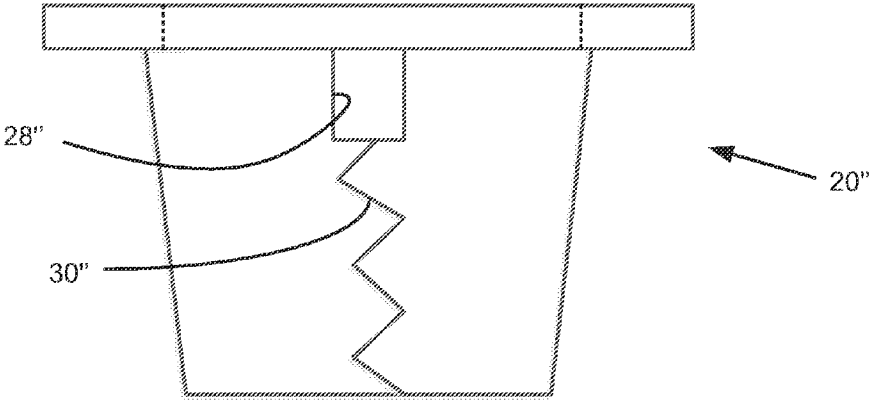
FIG. 6 is a top view of another embodiment of a marker.
Figure 7:
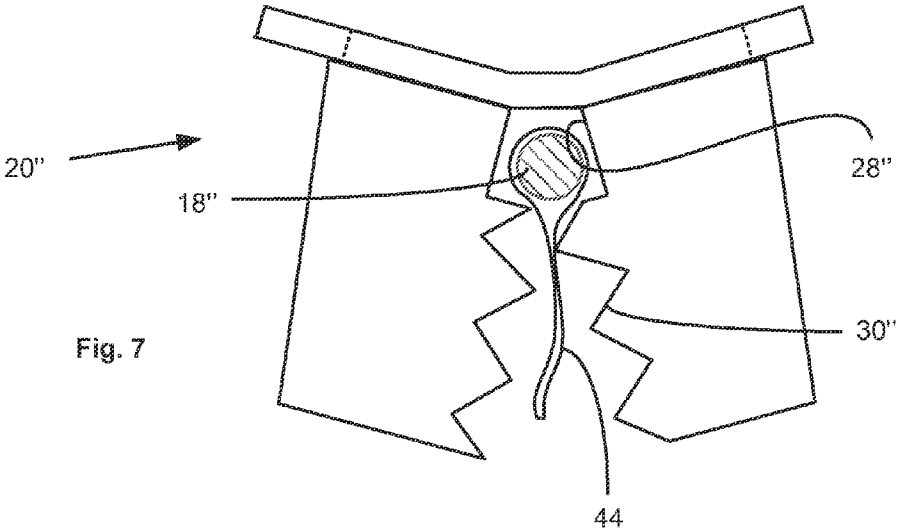
FIG. 7 is a top view of the marker of FIG. 6 in the open position.

FIGS. 6 and 7 show an alternative embodiment of a marker 20". This marker 20" is similar to the marker 20 described earlier, except that the left and right edges 30" have a zigzag surface, so that the legs 21, 23 have intermeshing teeth that provide a higher degree of "grip" on any item caught between the legs 21, 23, such as the "tail" 44 provided for the wire 18" of FIG. 7, as explained in more detail below.

Certain wires or elongated elements 18" to be marked and identified may be too fragile to "clamp" in the openings 28 of the marker 20 of FIG. 5. In this case, it may be desirable to attach a sleeve or "tail" 44 around the wire 18" and allow this "tail" 44 to be trapped in the intermeshing teeth formed by the zigzag slit 30" to secure the marker 20" to the wire 18". In this case, the openings 28" may be made with a larger diameter than the wire 18" (in this embodiment 20" they are shown larger and rectangular instead of circular) to ensure that the wire 18" will not be pinched by the marker 20". Other than these differences, the marker 20" operates in substantially the same manner as the marker 20 described earlier.

Figure 8:
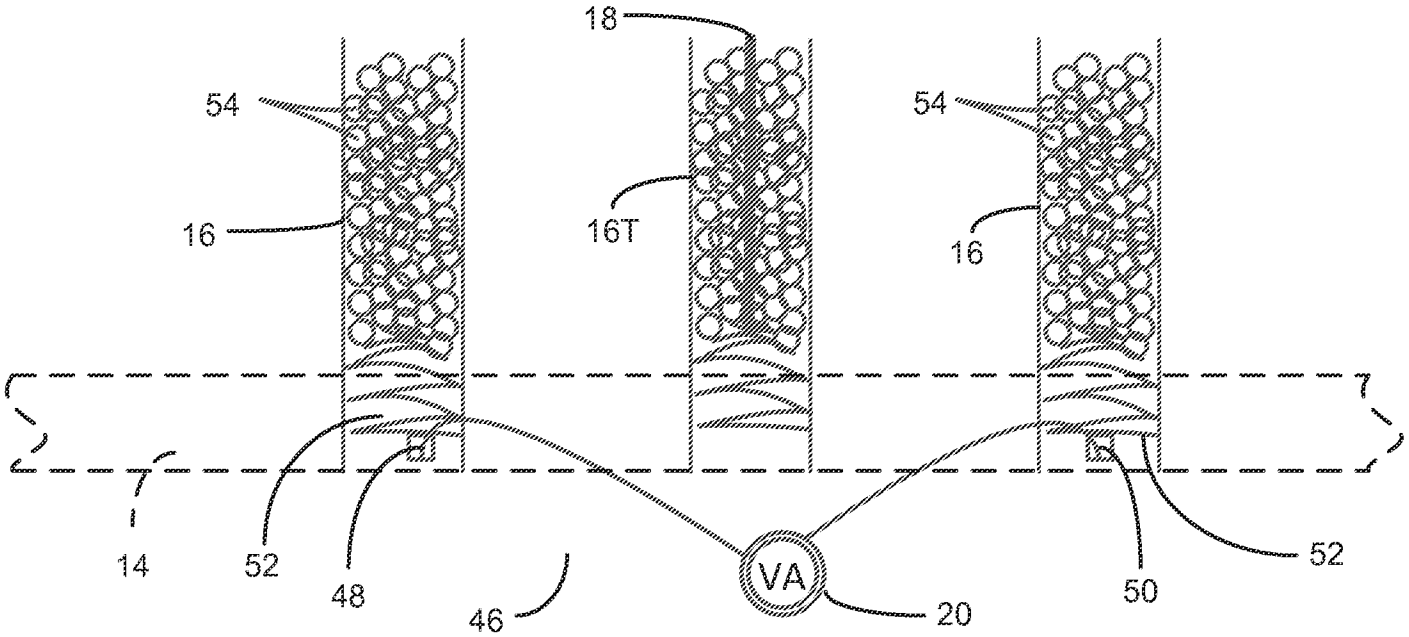
FIG. 8 is a broken away, enlarged view of the lower left portion of the reactor vessel of FIG. 1, including a marker for marking and identifying the wire.
Figure 9:
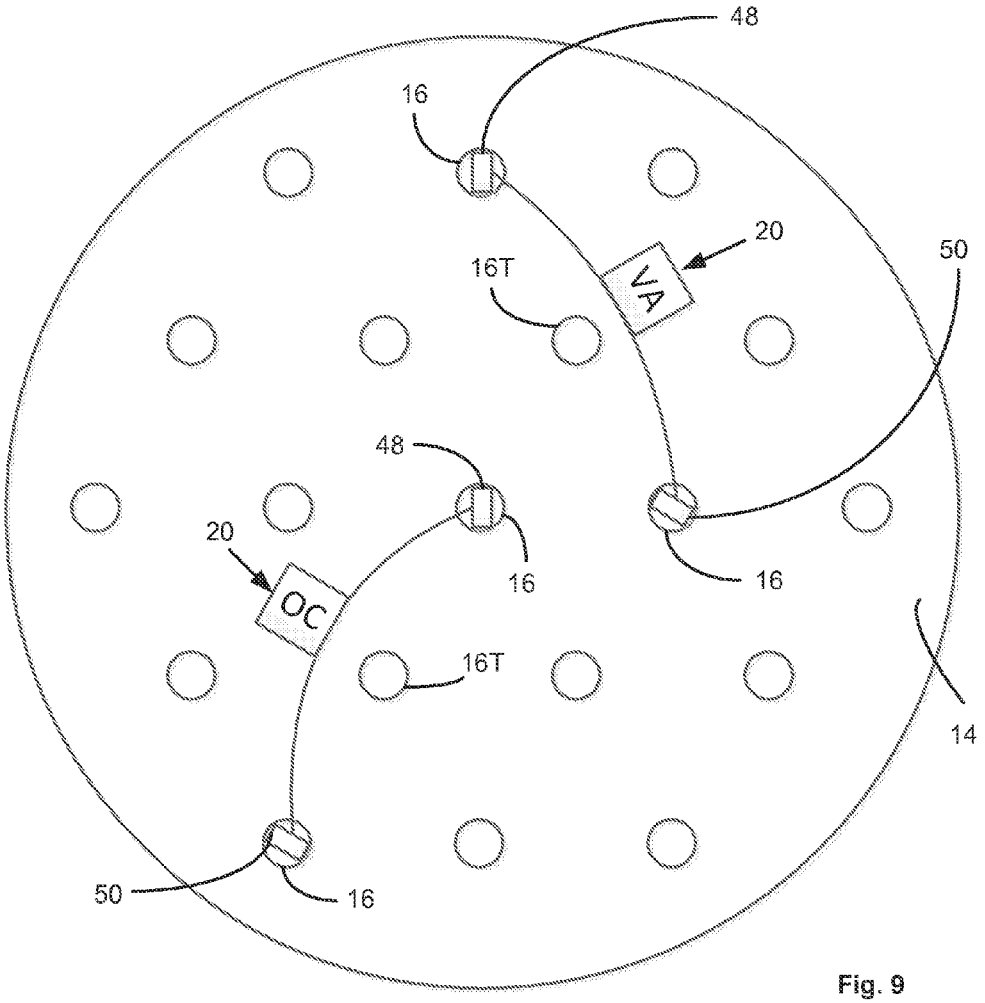
FIG. 9 is a bottom-up view of the bottom tube sheet of FIG. 1, including two markers.
Figure 10:
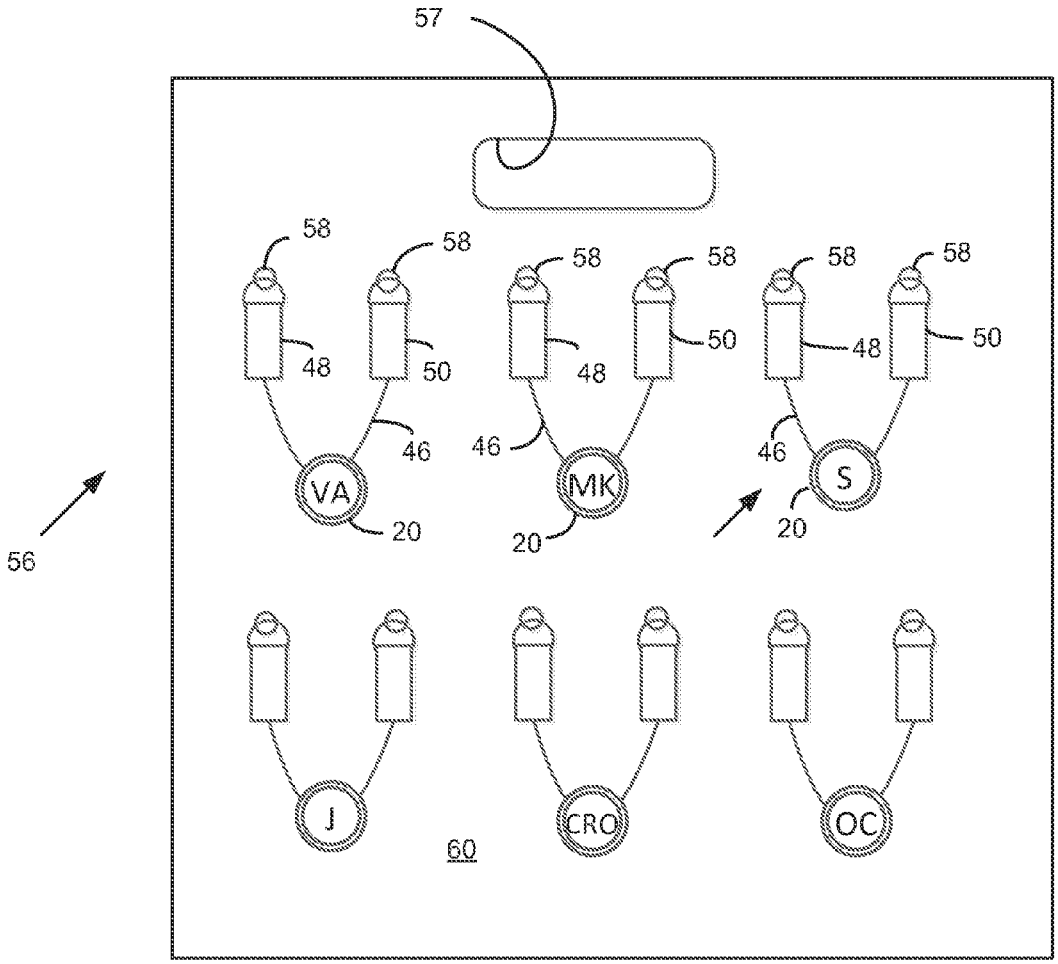
FIG. 10 is a side view of a portable carrying case to store and transport a plurality of the markers of FIGS. 8 and 9.

FIGS. 8-10 show another arrangement in which the marker 20 is used to mark at the bottom end of the tubes 16. In FIGS. 8 and 9, the marker 20 as described above is mounted on a wire 46, which has ends that terminate in hook-tips 48, 50, such as the spring-loaded hook-tip probes used to test electronic circuits. The hook tips 48, 50 can be deployed to latch onto a component lead or wire.

In this instance, the hook-tips 48, 50 are hooked onto the springs 52 at the bottom of the tubes 16 in the reactor vessel 10. As discussed earlier, these springs 52 are inserted at the bottom of the tubes 16 to keep the catalyst particles 54 from dropping out of the bottom of the tubes 16. As shown in FIGS. 8 and 9, the hook tips 48, 50 are hooked onto the springs 52 of tubes 16 which are adjacent a tube 16T which houses a thermocouple wire 18. The marker 20 is suspended from the wire 46, directly below the tube 16T, making it very readily visible to personnel inside the reactor vessel 10.

FIG. 10 shows a portable carrying case 56 to store and transport a plurality of markers 20 that are preassembled to wires 46. The case 56 is a flat plate 60, which defines an elongated opening 57 at its top end to act as a handle. A plurality of rings 58 are attached to the plate 60 in a spaced apart relationship, as shown. The hook tips 48, 50 at the ends of the wires 46 are attached to the rings 58 for storage. Each marker 20 is already preassembled with its corresponding wire 46 and its corresponding indicia 20.

The markers described above may be used to temporarily mark a wide variety of conduits, strips, wires, and other materials, and they can be used to mark these items in any desired orientation.

It will be obvious to those skilled in the art that modifications may be made to the embodiment described above without departing from the scope of the present invention as claimed.

What is claimed is:

1. A method for marking a wire, comprising the steps of:

providing a marker with a hollow tubular body defining an imaginary longitudinal axis and an imaginary crosswise line segment extending crosswise across the longitudinal axis, said imaginary crosswise line segment having first and second crosswise line segment ends located on the hollow tubular body, said hollow tubular body being formed by first and second legs having first and second ends with the first ends hinged together by a hinge, said marker defining first and second opposed openings at the first and second crosswise line segment ends, respectively, when the first and second legs are in a hinged closed position;

opening the hinge to move the first and second legs to a hinged open position in which the second ends of said legs are spaced apart from each other;

sliding the second ends of said legs over the wire until the wire enters said diametrically opposed openings; then closing the hinge to a hinge closed position so that the wire is received in said opposed openings and the edges of the first and second legs at the opposed openings enclose and grip at least a portion of the wire to hold the marker on the wire.

2. A method for marking a wire as recited in claim 1, wherein said hinge is a live hinge.

3. A method for marking a wire as recited in claim 2, wherein the second ends of said first and second legs are closed.

4. A method for marking a wire as recited in claim 3, wherein said first and second legs have straight side edges, so that, in the hinged closed position, the side edges of the first and second legs abut each other along a plane.

5. A method for marking a wire as recited in claim 3, wherein said first and second legs have zigzagged side edges, such that the side edges of the first and second legs define intermeshing teeth.

6. A method for marking a wire as recited in claim 3, and further comprising the step of providing indicia on said legs so as to identify the wire onto which the marker is placed.

7. A method for marking a wire as recited in claim 6, wherein the step of providing said indicia includes permanently securing a strong material to the second ends of said first and second legs after closing said first and second legs onto the wire in order to keep the first and second legs in the hinged closed position.

8. A method for marking a wire as recited in claim 1, wherein the step of opening the hinge includes the step of squeezing on diametrically opposed points on a flange which projects radially outwardly from said hollow tubular body at the first ends of said first and second legs.

9. A method for marking a wire as recited in claim 8, wherein the flange connects the first and second legs together, and the hinge is located on the flange.

* * * * *

UNITED STATES PATENT AND TRADEMARK OFFICE

CERTIFICATE OF CORRECTION

PATENT NO. : 9,293,067 B1
APPLICATION NO. : 13/790130
DATED : March 22, 2016
INVENTOR(S) : Clifford L. Johns It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 308 days.

Signed and Sealed this
Twenty-eighth Day of June, 2016

Michelle K. Lee

Michelle K. Lee
*Director of the United States Patent and Trademark Office*